US006459246B1

(12) United States Patent
Roo

(10) Patent No.: US 6,459,246 B1
(45) Date of Patent: Oct. 1, 2002

(54) VOLTAGE REGULATOR

(75) Inventor: Pierte Roo, Sunnyvale, CA (US)

(73) Assignee: Marvell International, Ltd., Hamilton (BM)

( * ) Notice: Subject to any disclaimer, the term of this patent is extended or adjusted under 35 U.S.C. 154(b) by 0 days.

(21) Appl. No.: 09/880,599

(22) Filed: Jun. 13, 2001

(51) Int. Cl.[7] ..... G05F 1/40
(52) U.S. Cl. ..... 323/270; 323/274
(58) Field of Search ..... 323/270, 273, 323/274, 275, 280, 281

(56) References Cited

U.S. PATENT DOCUMENTS

| | | | | |
|---|---|---|---|---|
| 4,400,660 A | * | 8/1983 | Schaefer | 323/270 |
| 4,413,226 A | | 11/1983 | Davies | 323/303 |
| 5,070,538 A | * | 12/1991 | Millberger | 323/270 |
| 5,130,635 A | | 7/1992 | Kase | 323/280 |
| 5,559,424 A | | 9/1996 | Wrathall et al. | 323/277 |
| 5,861,736 A | | 1/1999 | Corsi et al. | 323/273 |
| 6,037,759 A | | 3/2000 | Chen et al. | 323/280 |
| 6,075,351 A | | 6/2000 | Benes | 323/280 |
| 6,097,178 A | | 8/2000 | Owen et al. | 323/270 |

* cited by examiner

*Primary Examiner*—Jessica Han
(74) *Attorney, Agent, or Firm*—Eric B. Janofsky; Harness, Dickey & Pierce, P.L.C.

(57) ABSTRACT

A linear voltage regulator generates a regulated output voltage from a low overhead input voltage. The voltage regulator includes a series pass device that generates the output voltage based on a control signal. A sense circuit generates a sense signal that is proportional to the output voltage. An integrator generates an integrated signal based on a difference between a first voltage reference and the sense signal. The integrated signal includes a first voltage reference component and a sense signal component. A summer generates the control signal in response to the integrated signal, a second voltage reference, and the sense signal. The first voltage reference component of the integrated signal has the opposite polarity of the second voltage reference and the sense signal component of the integrated signal is of the same polarity as the sense signal.

70 Claims, 3 Drawing Sheets

VOLTAGE REGULATOR

FIELD OF THE INVENTION

The invention relates to integrated circuit voltage regulators, and in particular to a linear voltage regulator having a fast load transient response.

BACKGROUND OF THE INVENTION

Series pass voltage regulators are commonly used for providing a regulated low-noise output voltage from a higher input voltage to a load. Conventional voltage regulators generally include a combined integrator and proportional gain stage for controlling the output voltage. The integrator portion of the combined stage eliminates DC errors and the proportional gain portion of the combined stage permits adjustment of the overall loop gain to ensure loop stability. Often, the output load of the voltage regulator changes dynamically during normal operation of the circuit, sometimes varying from 100% to 0%, or 0% to 100% of the output current level in a matter of microseconds. Conventional voltage regulators typically respond relatively slowly to these load transients.

Designers also attempt to reduce noise levels at the output of the voltage regulator. Increasing load capacitance reduces noise levels at the output. However, the control loop of the conventional voltage regulator may become unstable if a large value of capacitance is coupled to the output. As a result of this relationship, designers must trade off noise and stability.

SUMMARY OF THE INVENTION

A voltage regulator method and circuit according to the invention provides a regulated output voltage to a load. The voltage regulator includes a series pass device that provides the regulated output voltage in response to a control signal. A sense circuit generates a sense voltage based on the regulated output voltage. An integrator stage receives a first reference voltage and the sense voltage and generates an integrated signal. A proportional gain and summer stage receives the sense voltage, the integrated signal, and a second reference voltage and generates the control signal to control the regulated output voltage.

In other features of the invention, the integrator stage and the proportional gain and summer stage have a combined gain approximately between 20 and 40. The integrator stage has a total gain approximately between 2 and 5. The proportional gain and summer stage has a total gain approximately between 5 and 10.

In still other features of the invention, the series pass device is selected from the group of PMOS transistors, PNP transistors, NMOS transistors, and NPN transistors. The integrator stage is selected from the group of active integrators and charge pump integrators. The sense circuit is selected from the group of buffers, direct connections, amplifiers, and passive networks.

In yet other features of the invention, the integrator stage includes an integrating circuit in series with a first inverting amplifier. The proportional gain and summer stage includes an amplifier in series with a second inverting amplifier. The series pass device includes an inverting transistor, the proportional gain stage includes a summing circuit in series with a second inverting amplifier, and the integrator stage includes an integrating circuit in series with a first inverting amplifier.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
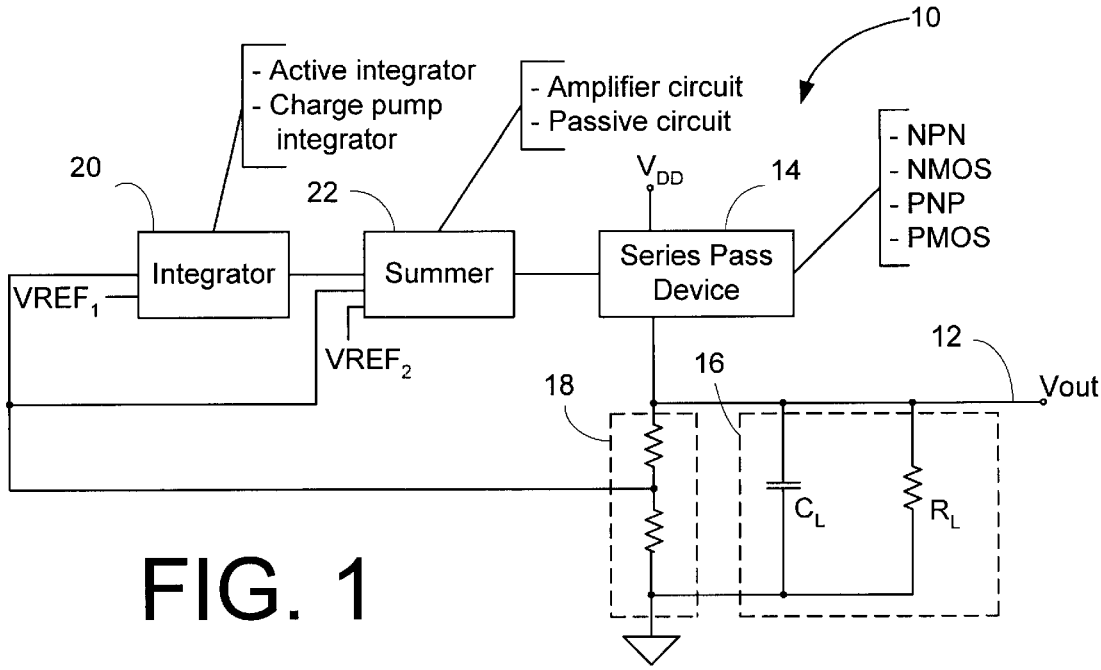
FIG. 1 illustrates a block diagram of a voltage regulator according to the present invention.

Referring now to FIG. 1, a block diagram of a voltage regulator 10 is shown. The voltage regulator 10 converts an unregulated input voltage ($V_{DD}$) to a regulated output voltage 12 ($V_{OUT}$) by dissipating power across a series pass device 14. The regulated output voltage 12 ($V_{OUT}$) is coupled to a load 16 that is represented as a lumped resistance ($R_L$) and capacitance ($C_L$). The advantages of the voltage regulator 10 are most pronounced when the series pass device 14 includes a PNP or PMOS transistor in an inverting configuration. However, other devices such as NMOS and NPN transistors are contemplated.

A sense network 18 monitors the regulated output voltage 12 with respect to a reference point such as ground. The sense network 18 is preferably a resistive divider. Other known sense networks 18 including direct connections, amplifiers, buffers, and/or passive networks are also contemplated. A sense signal from the sense network 18 is coupled to an integrator stage 20 and to a summer stage 22. Conventional voltage regulators combine the integrator and summer stages 20 and 22 into a single stage while the present invention splits the integrator and the summer stages 20 and 22. The independent design and operation of the integrator and summer stages 20 and 22 allows the overall gain to be optimized. By controlling the gain of the integrator and summer stages 20 and 22, the load transient response can be improved.

The integrator stage 20 compares the sense signal to a first reference voltage ($V_{REF1}$) and integrates the difference to eliminate DC offset error in the output voltage 12. The integrator stage 20 is preferably an active integrator. Other suitable integrators 20 such as charge pump integrators and current source integrators are also contemplated. The output of the integrator stage 20 is coupled to the summer stage 22 that sums the integrator output with the sense signal. The summer stage 22 compares the summed combination to a second reference voltage ($V_{REF2}$). The summer stage 22 is preferably an amplifier circuit that provides a proportional gain. Other suitable summers 22 such as passive circuits with a gain of less than one are also contemplated. The voltage level of the second voltage reference is preferably the same as the voltage level of the first voltage reference. An output of the summer 20 controls the series pass device 14 so that the regulated output voltage 12 is generated.

Figure 2:
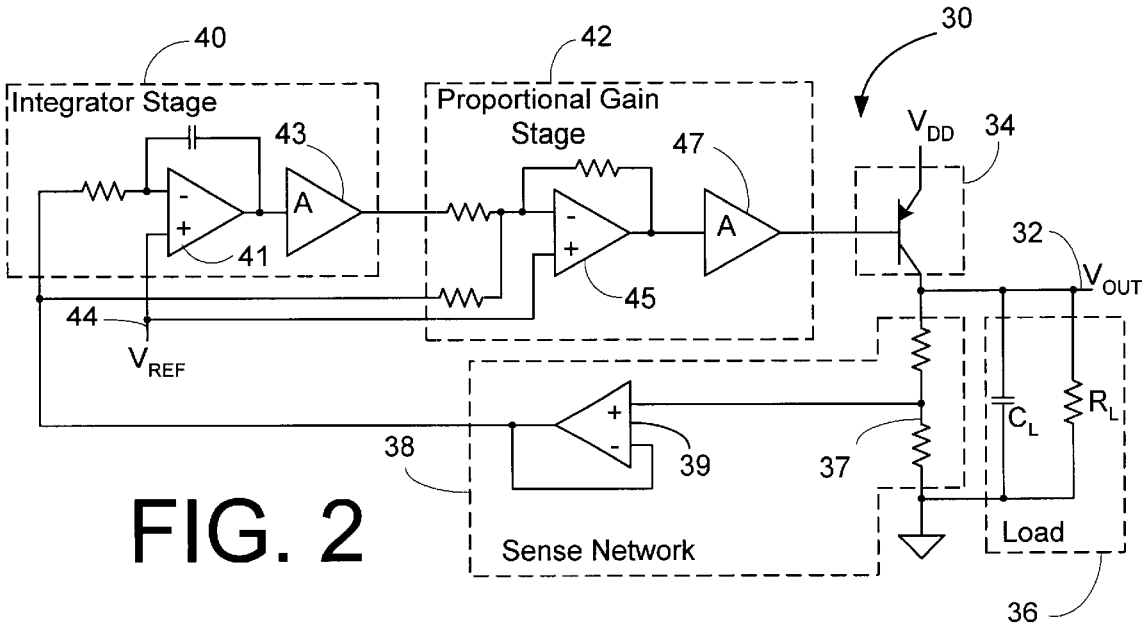
FIG. 2 illustrates a schematic of a presently preferred embodiment of the voltage regulator.

Referring now to FIG. 2, a schematic of a presently preferred embodiment of a voltage regulator 30 in accordance with the principles of the invention is illustrated. The voltage regulator 30 generates a regulated 1.8 volt output voltage 32 from a 2.5 volt source voltage ($V_{DD}$). The voltage regulator 30 includes a PNP series pass device 34 for dissipating excess power from $V_{DD}$ to provide the regulated output voltage 32 to the load 36. A sense network 38 including a resistive divider 37 and a buffer 39 generates a sense signal corresponding to the voltage level of the output voltage relative to circuit ground. The sense signal is coupled to both an integrator stage 40 and a proportional gain and summer stage 42. A reference voltage 44 ($V_{REF}$) is also coupled to both the integrator stage 40 and the proportional gain and summer stage 42.

The integrator stage 40 includes an integrator 41 followed by an inverting amplifier 43. The integrator 41 integrates the sense signal relative to the reference voltage and generates an integrated signal. The integrated signal is amplified and inverted by the inverting amplifier 43. The gain of the inverting amplifier 43 is preferably selected to be in the range of about 2 to 5. The output of the inverting amplifier 43 is summed with the sense signal within the proportional gain and summer stage 42.

The proportional gain and summer stage 42 combines the summing function with an amplification function in a first amplifier 45. The inverting amplifier output and the sense signal are summed through a pair of input resistors coupled to an inverting input of the first amplifier 45. The voltage reference 44 is coupled to a non-inverting input of the first amplifier 45 to provide an offset that cancels the voltage reference component from the integrator stage 40. The first amplifier 45 preferably provides unity gain for both inputs. The first amplifier 45 may also be configured to amplify the summed signal. A second amplifier 47 inverts the output of the first amplifier 45 and provides a combined gain of about 5 to 10 for the proportional gain and summer stage 42. The output of the second amplifier 47 controls the series pass device 34 so that the regulated output voltage 32 is generated. The combined gain of the voltage regulator 30 is preferably about 20 to 40. As can be appreciated, by separating the integrator and proportional gain and summer stages 40 and 42 and by controlling their respective gains, the voltage regulator 30 has a significantly improved load transient response.

Figure 3:
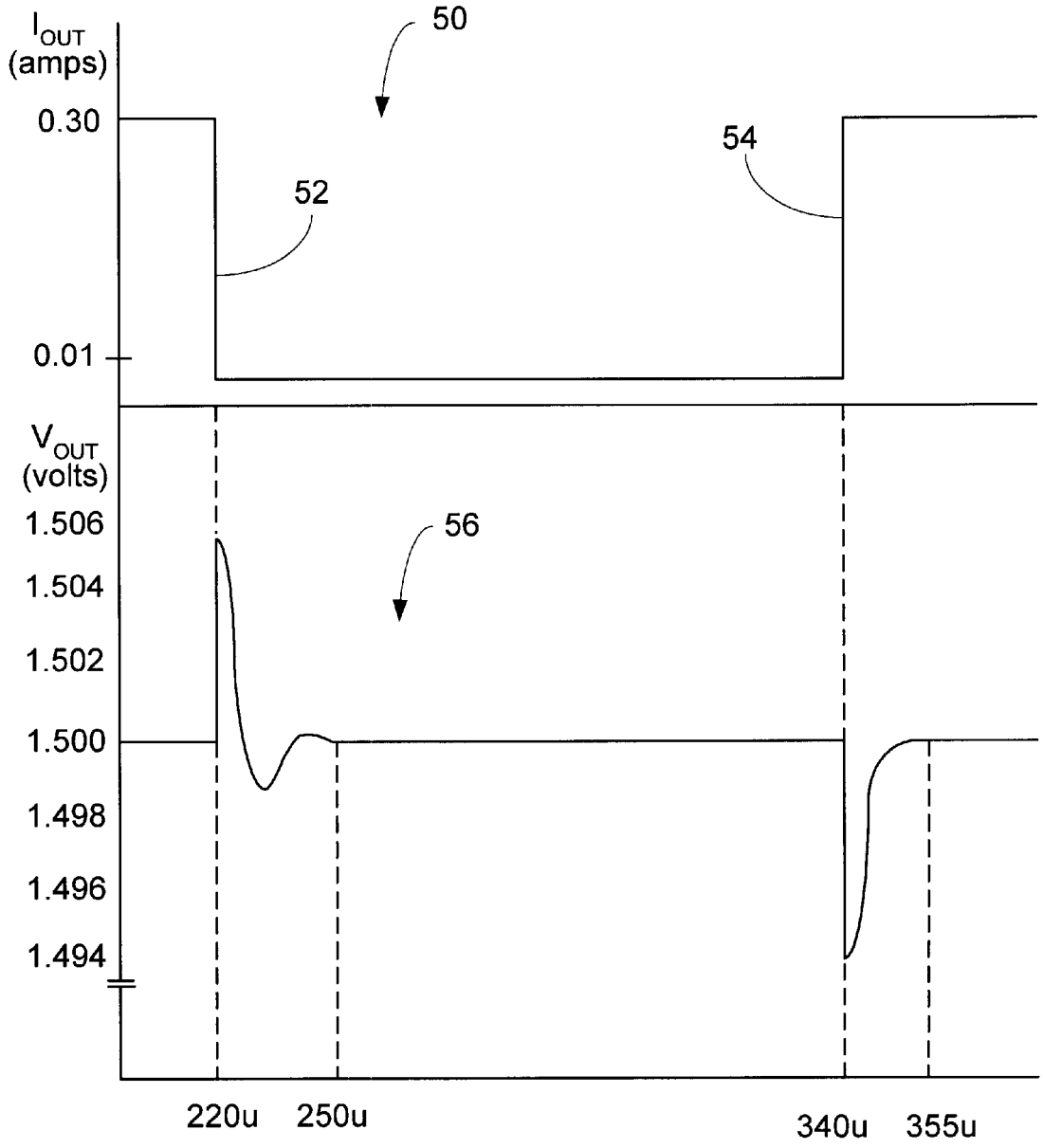
FIG. 3 illustrates waveforms corresponding to the output of the voltage regulator of FIG. 2.

Referring now to FIG. 3, waveforms of the load transient response of the presently preferred embodiment of the invention are illustrated. A first waveform 50 illustrates the output current of the voltage regulator 30 during load transients 52 and 54. The first load transient 52 causes the load current to transition from 300 mA to 10 mA. The second load transient 54 causes the load current to transition from 10 mA to 300 mA. The second waveform 56 shows the response of the output voltage 32 during each of the load transients 52 and 54. During the first load transient 52, the output voltage 54 displays a critically damped response. The output voltage 54 initially increases 6 mV, then swings below the steady-state level 1 mV, before settling at the steady-state voltage level within approximately 30 Ts of the onset of the first load transient 52. During the second load transient 54, the output voltage 54 displays an over-damped response. The output voltage 54 initially decreases 6 mV and then settles at the steady-state voltage level within 15 Ts of the second load transient 54.

Figure 4A:
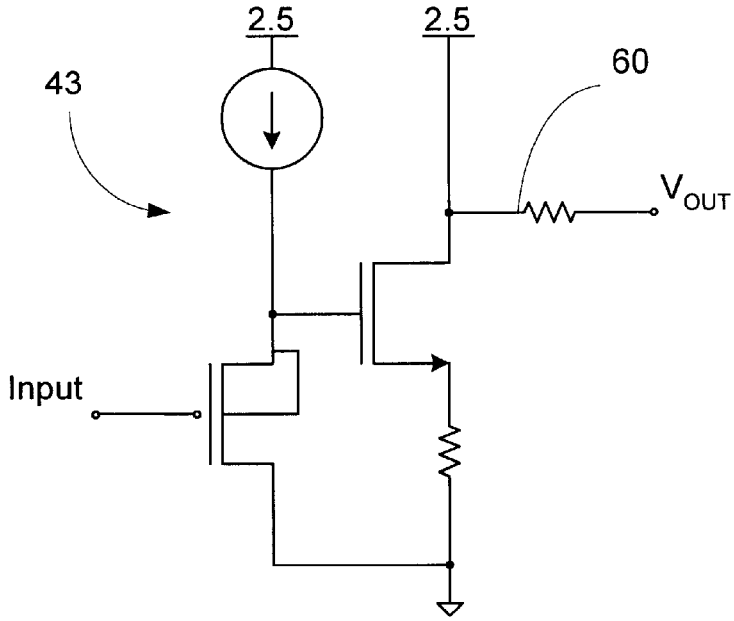
FIG. 4A is a detailed schematic of a presently preferred embodiment of an inverting amplifier used in the voltage regulator.
Figure 4B:
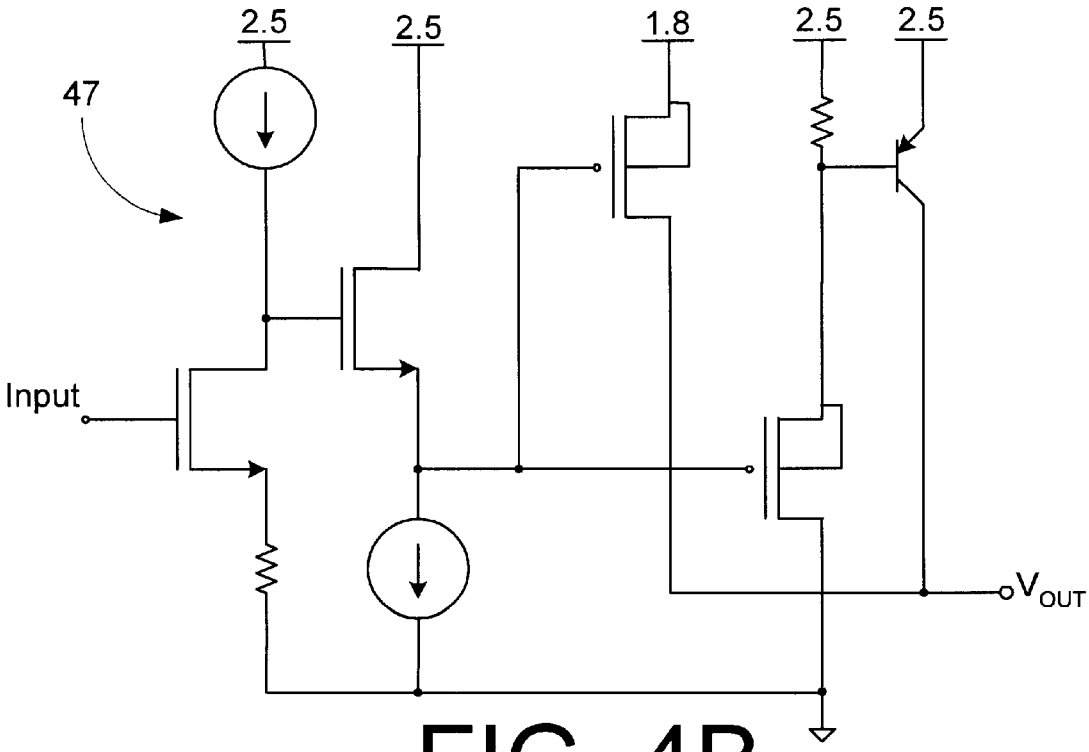
FIG. 4B is a detailed schematic of a presently preferred embodiment of a proportional gain and summer including an inverting amplifier and driver for a PNP transistor.

Referring now to FIG. 4A, an embodiment of an inverting amplifier 43 in accordance with the principles of the invention is shown. The inverting amplifier 43 amplifies and inverts the integrator output. A summing resistor 60 couples the output of the inverting amplifier 43 to an input of the proportional gain and summer stage 42. Referring now to FIG. 4B, an embodiment of an inverting amplifier 47 and driver for driving a PNP transistor proportional gain and summer and summer stage 42 is illustrated. The inverting amplifier 47 inverts the output of the proportional gain stage first amplifier 45.

Thus it will be appreciated from the above that as a result of the present invention, a circuit and method for regulating a voltage is provided by which the principal objectives, among others, are completely fulfilled. It will be equally apparent and is contemplated that modification and/or changes may be made in the illustrated embodiment without departure from the invention. Accordingly, it is expressly intended that the foregoing description and accompanying drawings are illustrative of preferred embodiments only, not limiting, and that the true spirit and scope of the present invention will be determined by reference to the appended claims and their legal equivalent.

What is claimed is:

1. A voltage regulator that provides a regulated output voltage to a load, comprising:

a series pass device that provides said regulated output voltage in response to a control signal;

a sense circuit that generates a sense voltage based on said regulated output voltage;

an integrator stage that receives a first reference voltage and said sense voltage and that generates an integrated signal; and a proportional gain and summer stage that receives said sense voltage, said integrated signal, and a second reference voltage and that generates said control signal to control said regulated output voltage.

2. The voltage regulator of claim 1 wherein said integrator stage and said proportional gain and summer stage have a combined gain approximately between 20 and 40.

3. The voltage regulator of claim 2 wherein said integrator stage has a total gain approximately between 2 and 5 and said proportional gain and summer stage has a total gain approximately between 5 and 10.

4. The voltage regulator of claim 1 wherein said series pass device includes one of a PNP transistor and a PMOS transistor in an inverting configuration.

5. The voltage regulator of claim 1 wherein said first reference voltage is approximately equal to said second reference voltage.

6. The voltage regulator of claim 1 wherein said series pass device is selected from the group of PMOS transistors, PNP transistors, NMOS transistors, and NPN transistors.

7. The voltage regulator of claim 1 wherein said integrator stage is selected from the group of active integrators and charge pump integrators.

8. The voltage regulator of claim 1 wherein said integrator stage includes an integrating circuit in series with a first inverting amplifier.

9. The voltage regulator of claim 1 wherein said proportional gain and summer stage includes an amplifier in series with a second inverting amplifier.

10. The voltage regulator of claim 1 wherein said sense circuit is selected from the group of buffers, direct connections, amplifiers, and passive networks.

11. The voltage regulator of claim 1 wherein said series pass device includes an inverting transistor, said proportional gain and summer stage includes a summing circuit in series with a second inverting amplifier, said integrator stage includes an integrating circuit in series with a first inverting amplifier.

12. A voltage regulator, comprising:

a series pass device that generates a regulated output voltage that is based on a control signal;

a sense circuit that generates a sense signal based on said regulated output voltage;

an integrator having a reference input coupled to a first voltage reference, a sense input coupled to said sense signal, and an output that generates an integrated signal based on a difference between said first voltage reference and said sense signal, wherein said integrated signal includes a first voltage reference component and a sense signal component; and a summer for generating said control signal in response to said integrated signal, a second voltage reference, and said sense signal, wherein said first voltage reference component of said integrated signal is of an opposite polarity to said second voltage reference, and wherein said sense signal component of said integrated signal is of the same polarity as said sense signal.

13. The voltage regulator of claim 12 wherein said series pass device is selected from the group of PMOS transistors, PNP transistors, NMOS transistors, and NPN transistors.

14. The voltage regulator of claim 12 wherein said integrator is selected from the group of active integrators and charge pump integrators.

15. The voltage regulator of claim 12 wherein said summer is selected from the group of active circuits and passive circuits.

16. The voltage regulator of claim 12 wherein said integrator includes an integrating circuit in series with a first inverting amplifier.

17. The voltage regulator of claim 12 wherein said summer includes a gain amplifier in series with a second inverting amplifier.

18. The voltage regulator of claim 12 wherein said sense circuit is selected from the group of buffers, direct connections, amplifiers, and passive networks.

19. The voltage regulator of claim 12 wherein said series pass device includes an inverting transistor, said summer includes a summing circuit in series with a second inverting amplifier, and said integrator includes an integrating circuit in series with a first inverting amplifier.

20. The voltage regulator of claim 12 wherein said first voltage reference is approximately equal to said second voltage reference.

21. A voltage regulator, comprising:

a series pass device, operable in response to a control signal, for generating a regulated output voltage;

an integrator having a non-inverting input coupled to a voltage reference, an inverting input coupled to a sense signal that is proportional to said regulated output voltage, and an output that generates an integrated signal in response to a difference between said voltage reference and said sense signal;

a first inverting amplifier that inverts said integrated signal;

a summer having a non-inverting input coupled to said voltage reference, an inverting input coupled to a combined signal containing said integrated signal and said sense signal, wherein said summer generates a summed signal in response to a difference between said voltage reference and said combined signal; and a second inverting amplifier that generates said control signal in response to said summed signal.

22. The voltage regulator of claim 21 wherein said integrator is selected from the group of active integrators and charge pump integrators.

23. The voltage regulator of claim 21 wherein said summer is selected from the group of active circuits and passive circuits.

24. The voltage regulator of claim 21 wherein said series pass device is selected from the group of PMOS and PNP transistors.

25. The voltage regulator of claim 21 further comprising a buffer amplifier that generates said sense signal.

26. A voltage regulator that provides a regulated output voltage to a load, comprising:

first circuit means for providing said regulated output voltage in response to a control signal;

sensing means for generating a sense voltage based on said regulated output voltage;

integrating means for receiving a first reference voltage and said sense voltage and for generating an integrated signal; and second circuit means for receiving said sense voltage, said integrated signal, and a second reference voltage and for generating said control signal to control said regulated output voltage.

27. The voltage regulator of claim 26 wherein said integrating means and said second circuit means have a combined gain between approximately 20 and 40.

28. The voltage regulator of claim 26 wherein said integrating means has a total gain between approximately 2 and 5 and said second circuit means has a total gain between approximately 5 and 10.

29. The voltage regulator of claim 26 wherein said first circuit means includes one of a PNP transistor and a PMOS transistor in an inverting configuration.

30. The voltage regulator of claim 26 wherein said first reference voltage is approximately equal to said second reference voltage.

31. The voltage regulator of claim 26 wherein said first circuit means is selected from the group of PMOS transistors, PNP transistors, NMOS transistors, and NPN transistors.

32. The voltage regulator of claim 26 wherein said integrating means is selected from the group of active integrators and charge pump integrators.

33. The voltage regulator of claim 26 wherein said integrating means includes an integrating circuit in series with a first inverting amplifier.

34. The voltage regulator of claim 26 wherein said second circuit means includes an amplifier in series with a second inverting amplifier.

35. The voltage regulator of claim 26 wherein said sensing means is selected from the group of buffers, direct connections, amplifiers, and passive networks.

36. The voltage regulator of claim 26 wherein said first circuit means includes an inverting transistor, said second circuit means includes a summing circuit in series with a second inverting amplifier, and said integrating means includes an integrating circuit in series with a first inverting amplifier.

37. A voltage regulator comprising:

first circuit means for generating a regulated output voltage that is based on a control signal;

sense means for generating a sense signal based on said regulated output voltage;

integrating means, having a reference input coupled to a first voltage reference, a sense input coupled to said sense signal, and an output, said integrating means for generating an integrated signal based on a difference between said first voltage reference and said sense signal, wherein said integrated signal includes a first voltage reference component and a sense signal component; and summing means for generating said control signal in response to said integrated signal, a second voltage reference, and said sense signal, wherein said first voltage reference component of said integrated signal is of an opposite polarity to said second voltage reference, and wherein said sense signal component of said integrated signal is of the same polarity as said sense signal.

38. The voltage regulator of claim 37 wherein said first circuit means is selected from the group of PMOS transistors, PNP transistors, NMOS transistors, and NPN transistors.

39. The voltage regulator of claim 37 wherein said integrating means is selected from the group of active integrators and charge pump integrators.

40. The voltage regulator of claim 37 wherein said summing means is selected from the group of active circuits and passive circuits.

41. The voltage regulator of claim 37 wherein said integrating means includes an integrating circuit in series with a first inverting amplifier.

42. The voltage regulator of claim 37 wherein said summing means includes a gain amplifier in series with a second inverting amplifier.

43. The voltage regulator of claim 37 wherein said sensing means is selected from the group of buffers, direct connections, amplifiers, and passive networks.

44. The voltage regulator of claim 37 wherein said first circuit means includes an inverting transistor, said summing means includes a summing circuit in series with a second inverting amplifier, and said integrating means includes an integrating circuit in series with a first inverting amplifier.

45. The voltage regulator of claim 37 wherein said first voltage reference is approximately equal to said second voltage reference.

46. A voltage regulator comprising:

first circuit means, operable in response to a control signal, for generating a regulated output voltage;

integrating means having a non-inverting input coupled to a voltage reference, an inverting input coupled to a sense signal that is proportional to said regulated output voltage, and an output, said integrating means for generating an integrated signal in response to a difference between said voltage reference and said sense signal;

a first inverting means for inverting said integrated signal;

summing means, having a non-inverting input coupled to said voltage reference, an inverting input coupled to a combined signal containing said integrated signal and said sense signal, said summing means for generating a summed signal in response to a difference between said voltage reference and said combined signal; and a second inverting means for generating said control signal in response to said summed signal.

47. The voltage regulator of claim 46 wherein said integrating means is selected from the group of active integrators and charge pump integrators.

48. The voltage regulator of claim 46 wherein said summing means is selected from the group of active circuits and passive circuits.

49. The voltage regulator of claim 46 wherein said first circuit means is selected from the group of PMOS and PNP transistors.

50. A method of producing a regulated output voltage, comprising the steps of:

a) generating an integrated signal based upon a difference between a first voltage reference signal and a sense signal, wherein said sense signal is based on said regulated output voltage;

b) summing said integrated signal and said sense signal to generate a combined signal;

c) subtracting a second voltage reference signal from said combined signal to generate a control signal; and d) controlling a series pass device based upon said control signal such that said regulated output voltage is generated.

51. The method of claim 50 further comprising the step of controlling a combined gain of steps a), b) and c) between approximately 20 and 40.

52. The method of claim 50 further comprising the step of controlling a first gain of step a) between approximately 2 and 5 and a second gain of steps b) and c) between approximately 5 and 10.

53. The method of claim 50 wherein said series pass device includes one of a PNP transistor and a PMOS transistor in an inverting configuration.

54. The method of claim 50 wherein said series pass device is selected from the group of PMOS transistors, PNP transistors, NMOS transistors, and NPN transistors.

55. The method of claim 50 wherein step a) is performed by one of an active integrator and a charge pump integrator.

56. The method of claim 50 wherein step a) is performed by an integrating circuit in series with a first inverting amplifier.

57. The method of claim 50 wherein steps b) and c) are performed by an amplifier in series with a second inverting amplifier.

58. The method of claim 50 wherein said sense signal is generated by a device selected from the group of buffers, direct connections, amplifiers, and passive networks.

59. A method for providing a regulated output voltage, comprising the steps of:

controlling said regulated output voltage based on a control signal;

producing a sense signal based on said regulated output voltage;

generating an integrated signal based on a difference between a first voltage reference and said sense signal wherein said integrated signal includes a first voltage reference component and a sense signal component; and generating said control signal in response to said integrated signal, a second voltage reference, and said sense signal, wherein said first voltage reference component of said integrated signal is of an opposite polarity to said second voltage reference, and wherein said sense signal component of said integrated signal is of the same polarity as said sense signal.

60. The method of claim 59 further comprising the step of producing said regulated output voltage using a series pass device that is selected from the group of PMOS transistors, PNP transistors, NMOS transistors, and NPN transistors.

61. The method of claim 59 further comprising the step of generating said integrated signal using an integrator that is selected from the group of active integrators and charge pump integrators.

62. The method of claim 59 further comprising the step of producing said control signal using a summer that is selected from the group of active circuits and passive circuits.

63. The method of claim 59 further comprising the step of generating said integrated signal using an integrator that includes an integrating circuit in series with a first inverting amplifier.

64. The method of claim 59 wherein said summer includes a gain amplifier in series with a second inverting amplifier.

65. The method of claim 59 further comprising the step of selecting said sense circuit from the group of buffers, direct connections, amplifiers, and passive networks.

66. The method of claim 59 wherein said first voltage reference is approximately equal to said second voltage reference.

67. A method for producing a regulated output voltage, comprising the steps of:

generating said regulated output voltage using a series pass device that is operable in response to a control signal;

producing an integrated signal in response to a difference between said voltage reference and said sense signal using an integrator having a non-inverting input coupled to a voltage reference, an inverting input coupled to a sense signal that is proportional to said regulated output voltage, and an output;

inverting said integrated signal using a first inverting amplifier;

generating a summed signal in response to a difference between said voltage reference and a combined signal using a summer having a non-inverting input coupled to said voltage reference and an inverting input coupled to said combined signal containing said integrated signal and said sense signal; and producing said control signal in response to said summed signal using a second inverting amplifier.

68. The method of claim 67 further comprising the step of selecting said integrator from the group of active integrators and charge pump integrators.

69. The method of claim 67 further comprising the step of selecting said summer from the group of active circuits and passive circuits.

70. The method of claim 67 further comprising the step of selecting said series pass device from the group of PMOS and PNP transistors.

* * * * *